United States Patent [19]

Beckett

[11] Patent Number: 4,572,377

[45] Date of Patent: Feb. 25, 1986

[54] PACKAGING STRUCTURE

[76] Inventor: Donald E. Beckett, 963 Tennyson Ave., Mississauga, Ontario, Canada, L5H 2Y9

[21] Appl. No.: 631,473

[22] Filed: Jul. 16, 1984

[51] Int. Cl.[4] ..... B65D 33/20; B65D 33/34

[52] U.S. Cl. ..... 206/610; 206/632; 206/611; 383/5; 383/95

[58] Field of Search ..... 206/610, 632, 807, 611, 206/628, 624; 383/63, 95, 5; 428/43, 136

[56] References Cited

U.S. PATENT DOCUMENTS

| | | | |
|---|---|---|---|
| 3,456,867 | 7/1969 | Repko | 206/632 |
| 3,504,475 | 4/1970 | Dickard et al. | 206/632 |
| 3,606,133 | 9/1971 | Meyers | 206/622 |
| 3,613,874 | 10/1971 | Miller | 206/637 |
| 3,619,395 | 11/1971 | Skendzic | 383/63 |
| 3,625,270 | 12/1971 | Skendzic | 383/63 |
| 3,735,916 | 5/1973 | Buttery | 206/628 |
| 3,827,472 | 8/1974 | Uramoto | 383/63 |
| 4,015,771 | 4/1977 | Sengebald | 206/632 |

*Primary Examiner*—Stephen P. Garbe
*Attorney, Agent, or Firm*—Sim & McBurney

[57] ABSTRACT

A packaging structure formed of flexible polymeric material is disclosed. A resealable seal is provided to permit opening and reclosing of the package to permit multiple time access to the contents of the package. A tamper-evident indicator is provided in association with the resealable seal to indicate whether or not undesired access to the contents has been had. The tamper-evident indicator comprises a permanent heat seal spaced from the resealable seal and a tear strip between the two seals. When the tear strip is present, the permanent seal maintains the structure closed while removal of the tear strip permits opening of the resealable seal.

2 Claims, 3 Drawing Figures

PACKAGING STRUCTURE

FIELD OF INVENTION

The present invention relates to a novel packaging structure useful for packaging a variety of products, including food products and medicines.

BACKGROUND OF THE INVENTION

It is known to provide flexible polymeric film packages which have an openable and resealable seal. In such packages, a slit is formed through one side of the enclosed package to provide an opening to the package. A further strip of flexible polymeric film material is adhered to the outer surface of the package adjacent the slit with a free longitudinal edge overlying the slit. A narrow strip of pressure-sensitive adhesive is provided adjacent the free longitudinal edge along the length of the slit so as to releasably engage the film on one lateral side of the slit while the strip is permanently adhered to the film on the other lateral side of the slit. In this way, access to the contents of the package may be attained by peeling apart the free edge of the strip and the underlying film along the line of adhesive. Following removal of the desired contents, the package may be temporarily resealed by pressing the separated films together along the line of the adhesive.

While such an arrangement is satisfactory with respect to opening and resealing packages to permit access to the contents of the package only when desired, no provision is made to ensure that a package displayed, for example, on a supermarket shelf, has not been opened, part of the contents removed and the package resealed. In addition, the structure requires a separate strip of material and slitting and adhering operations to be effected.

SUMMARY OF INVENTION

In accordance with the present invention, there is provided an improvement on the prior art polymeric film packages by providing tamper-evident means in association with a resealable seal, so as to indicate whether a package has been opened or is in its factory-sealed condition. In the present invention, the resealable seal may be provided between overlying layers of material of the package, and thereby avoid the necessity for a slitting operation and a separate strip of material.

The tamper-evident means may be provided by a second permanent seal joining the overlying films located adjacent a free edge of the overlying films and spaced apart from the resealable seal and a tear strip between the seals and formed in the outer one only of the overlying films.

When the tear strip is intact, access to the contents of the package cannot be attained without destroying the integrity of the package, since the permanent seal prevents separation of the overlying films of the package.

Once the tear strip is removed, however, then access to the contents of the package may be had through the resealable seal of the package, since the permanent seal now has been isolated from the resealable seal. A consumer purchasing a product packaged in such a package is able to determine very rapidly whether or not the package has been tampered with prior to purchase. If the tear strip is intact, the package remains in its factory-sealed state while, if the tear strip has been removed, the package has been tampered with and product may have been removed from the package or contaminated.

The tear strip may take any convenient form, for example, an array of chevron-shaped cuts formed at least partially through the outer layer and parallel score lines adjacent thereto, or a series of zed-shaped cuts formed at least partially through the outer layer and having the arms extending in alignment with each other.

A wide variety of products may be packaged in the package of the invention but the tamper-evident feature is most useful when food products and medicines are packaged, since it is important that such products reach the consumer in their factory-sealed condition to avoid any possibility of product having been removed or having become contaminated, either accidentally or deliberately.

DESCRIPTION OF PREFERRED EMBODIMENT

Figure 1:
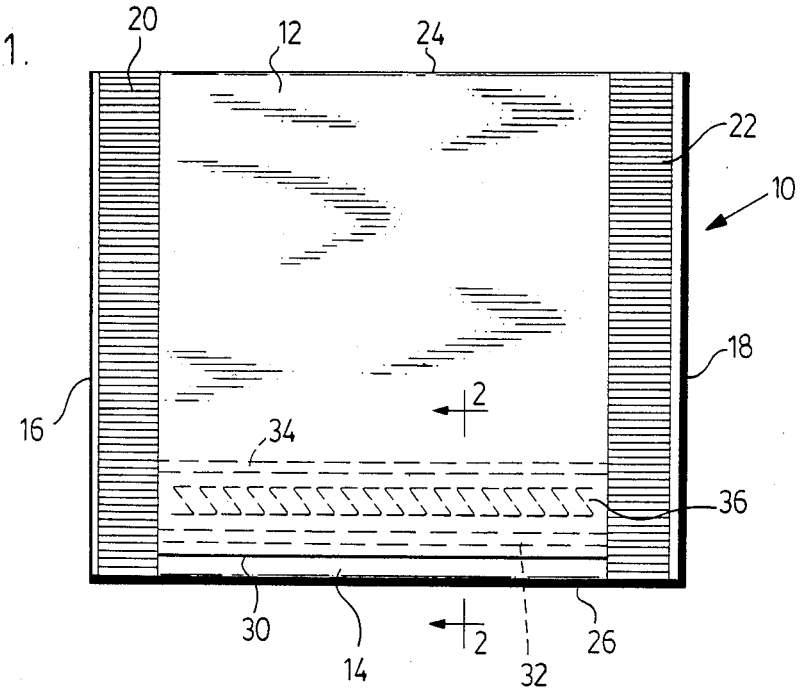
FIG. 1 is a perspective view of a package having a seal provided in accordance with this invention.
Figure 2:
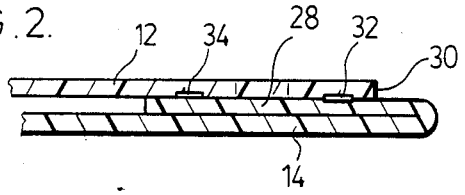
FIG. 2 is a sectional view taken on line 2—2 of FIG. 1.
Figure 3:
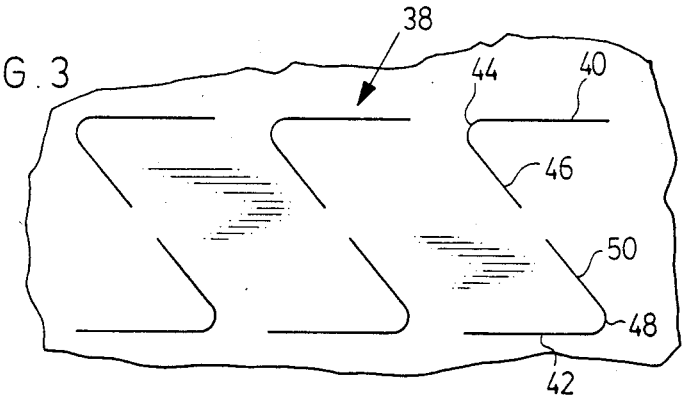
FIG. 3 is a close-up of the tear strip used in the packaging structure of FIG. 1.

Referring to the drawings, there is illustrated therein a package 10 comprising a pair of overlying heat-sealable flexible plastic films 12 and 14. The overlying films 12 and 14 are heat sealed together at their side edges 16 and 18, by seals 20 and 22. At one longitudinal edge 24 the films 12 and 14 are joined, such as by sealing or by folding over while at the other longitudinal edge 26, the lower film 14 is folded over to provide a flap 28 underlying the free longitudinal edge 30 of the upper film 12.

The overlying portions of the upper film 12 and the flap 28 constitute the opening to the package 10, which is otherwise enclosed on all sides, as described above. Adjacent the longitudinal free edge 30 of the upper film 12, a permanent heat seal 32 is formed between the upper film 12 and the flap 28 across the width of the films between the side seals 20 and 22, so that the package 10 cannot be opened by separation of the films 12 and 14 without destroying the overall integrity of the package 10.

Spaced from the permanent heat seal 32 towards the one longitudinal side edge 24 and extending parallel thereto is a resealable seal 34. The resealable seal 34 may comprise a strip of pressure-sensitive adhesive adhered to the upper film 12 and peelable from the flap 28. In the absence of the permanent heat seal 32, the package 10 may be opened by separation of the layers along the peelable seal 34 and reclosed by press engagement between the adhesive strip 34 and the flap 28.

A tear strip 36 is formed between the two parallel seals 32 and 34 to permit removal of plastic film material from the upper film 12 between the seals 32 and 34. Once the tear strip 36 is removed, the permanent seal 32 no longer prevents the package 10 from being opened by separation of the overlying films along the peelable seal 34.

The tear strip 36 may take any convenient form which enables the function of the permanent seal 32 to be inactivated and access to the package to be obtained through the peelable seal 34. The tear strip 36 in the illustrated embodiment comprises a series of Z-shaped cuts 38 formed through the thickness of the upper film.

The Z-shaped cuts 38 each comprises arms 40 and 42 which are in straight-line alignment with the corresponding arms of the other Z-shaped cuts. The arm 40 is joined through a rounded corner 44 to a diagonally-directed cut line 46. The arm 42 is joined through a rounded corner 48 to a second diagonally-directed cut line 50 which is in straight-line alignment with cut line 46.

The form of the tear strip 36 provides good lateral strength which inhibits accidental removal of the tear strip and yet permits the tear strip 36 to be removed in a single pull of the strip. The pull open of the tear strip 36 may be effected by commencing with a pull-away at corner 48 and then drawing the material down the strip 36, to sever and detach the remaining uncut material in the strip 36.

Alternatively, any other convenient form of tear strip 36 may be provided between the seals 32 and 34. For example, the tear strip 36 may be provided by a series of chevron-shaped cuts formed through the thickness of the upper film and having their apices located on a straight line parallel to the seals 32 and 34 and a pair of parallel score lines located one on each side of the chevron cuts. The chevron cuts weaken the material of the strip between the score lines to enable the tear strip to be readily detached along the score lines.

The provision of the combination of the permanent seal 32, the resealable seal 34 and the tear strip 36 uniquely combines the attributes of a resealable seal while providing permanent sealing of the package 10 until desired to be opened by the consumer. The absence of the tear strip 36 from any package received by the consumer shows that the package has been tampered with and product removed from the package or contaminated.

The package 10 of the invention, therefore, remains sealed and access cannot be had to the contents of the package 10 without removal of the tear strip 36 or by destroying the integrity of the package, thereby ensuring that when the package is received by the consumer intact with the tear strip in place, the contents of the package are as they left the packer. Once the tear strip 36 has been removed from the package, the contents of the package 10 may be accessed by separating the overlying films 12 and 14 along the resealable seal 34. Once the desired quantity of the contents of the package has been removed, the package may be reclosed by pressing the overlying films 12 and 14 together along the resealable seal 34. The procedure of opening, removal of product and resealing may be repeated as often as desired and as permitted by the number of items packaged therein.

The material of construction of the package 10 is flexible polymeric film, which may be a single polymeric material or a laminate of two different polymeric materials to impart different properties to the film.

For example, a flat sheet of heat-sealable flexible polymeric film may be die-cut continuously to provide the tear strip 36 while a strip of pressure-sensitive adhesive is applied to the film, desired lengths of film cut from the strip and the film folded and heat sealed to provide the side seals 20 and 22 and the permanent seal 32. The packages may be formed in any convenient manner.

SUMMARY OF DISCLOSURE

In summary of this disclosure, the present invention provides a novel resealable packaging structure which has openable permanent sealing means which prevents tampering with the package and maintains the package sealed until the consumer opens the package to obtain access to the contents thereof. Modifications are possible within the scope of this invention.

What I claim is:

1. A packaging structure of flexible polymeric material, comprising:

a generally rectangular first layer of flexible polymeric material having a top edge, a bottom edge and two side edges, a generally rectangular second layer of flexible polymeric material overlying said first layer and having a top edge, a bottom edge and two side edges, said side edges of said first layer and of said second layer and said bottom edge of said first layer and of said second layer being joined together to define a cavity between said overlying layers, said top edge of said first layer being defined by a fold line formed by folding a portion of said first layer over on itself, said folded-over portion having a first face abutting the first layer and a second face abutting one face of the second layer, a permanent line seal formed between said abutting second face of said folded-over portion and said abutting one face of said second layer adjacent and parallel to said top edge of both said first and second layers, a resealable line seal parallel to and spaced from said permanent line seal a distance from said top edges greater than that of said permanent line seal from said top edges, said resealable line seal comprising a line of adhesive mounted to said abutting one face of said second layer and releasably bonded to said second face of said folded-over portion, and a tear strip formed in the second layer parallel to and located between said permanent line seal and said resealable line seal for rupturing the polymeric material between said permanent line seal and said resealable line seal in said second layer, whereby, upon removal of said tear strip said permanent line seal is disabled and said resealable line seal may be opened to permit access to the cavity and reclosed.

2. The packaging structure of claim 1 wherein said tear strip comprises an array of cuts formed through the second layer from an outer surface thereof to said abutting one face, said cuts being formed of pairs of parallel lines with one member of each pair in straight-line alignment along the length of the tear strip and pairs of diagonal lines extending from an arcuate join with one of said parallel lines towards but stopping short of each other.

* * * * *